US006158683A

United States Patent [19]

David et al.

[11] Patent Number: 6,158,683

[45] Date of Patent: Dec. 12, 2000

[54] APPARATUS FOR FORMING ROLLED WIRE-ROD COIL

[75] Inventors: Siegfried David; Karl Keller, both of Hilchenbach, Germany

[73] Assignee: SMS Schloemann-Siemag AG, Dusseldorf, Germany

[21] Appl. No.: 09/270,393

[22] Filed: Mar. 16, 1999

[30] Foreign Application Priority Data

Mar. 18, 1998 [DE] Germany ..... 198 11 649

[51] Int. Cl.[7] ..... B21C 47/02

[52] U.S. Cl. ..... 242/363; 242/360

[58] Field of Search ..... 242/363, 361.2, 242/361.4, 360, 157 R, 615.2

[56] References Cited

U.S. PATENT DOCUMENTS

| | | | |
|---|---|---|---|
| Re. 35,440 | 2/1997 | Starvaski | 242/363 |
| 4,221,345 | 9/1980 | Schippers et al. | 242/361.4 |
| 4,304,366 | 12/1981 | Enneking et al. | 242/361.4 X |
| 4,339,091 | 7/1982 | Enneking et al. | 242/361.4 X |
| 4,376,517 | 3/1983 | Schippers | 242/361.4 X |
| 5,273,231 | 12/1993 | Starvaski | 242/363 |
| 5,779,174 | 7/1998 | Starvaski et al. | 242/363 |
| 6,073,873 | 6/2000 | Shore et al. | 242/363 |

FOREIGN PATENT DOCUMENTS

| | | | |
|---|---|---|---|
| 0 583 099 | 2/1994 | European Pat. Off. . | |
| 0 686 438 | 12/1995 | European Pat. Off. . | |
| 0 686 439 | 12/1995 | European Pat. Off. . | |
| 3117181 | 11/1982 | Germany | 242/360 |
| 3330257 | 9/1983 | Germany | 242/360 |
| 3709271 | 4/1988 | Germany | 242/360 |
| 197 04 421 | 8/1998 | Germany . | |

*Primary Examiner*—Donald P. Walsh
*Assistant Examiner*—William A Rivera
*Attorney, Agent, or Firm*—Herbert Dubno

[57] ABSTRACT

Successive rolled wire rod turns from a substantially horizontal conveyor are collected in an upright coiling chamber and are guided onto the coil on a support plate in this chamber by a plurality of angularly spaced arms swingably mounted outside the chamber and reaching into the chamber through slits in the chamber wall. The arms are displaced by a drive acting on the back portions of the arms, i.e. the portions opposite that engaging the turns.

17 Claims, 4 Drawing Sheets

APPARATUS FOR FORMING ROLLED WIRE-ROD COIL

FIELD OF THE INVENTION

Our present invention relates to an apparatus for forming coils of rolled wire rod and, more particularly to an apparatus for guiding and transversely shifting rolled wire rod turns or "rings" which arrive in a spencerian or overlapped pattern on a substantially horizontal conveyor and from which the turns or rings are transferred to an upright collecting chamber in which the turns or rings accumulate to form a coil.

The invention relates specifically to the means for guiding and transversely shifting the rolled wire rod turns or rings as they are cast off from the conveyor and fall onto a collecting surface in the interior of a coil-forming chamber and especially to a guiding arrangement in which transverse shifting elements engage such turns.

BACKGROUND OF THE INVENTION

At the downstream end of rod mills the rolled wire rod is normally collected in coils which can be bound for storage or shipment. The coil-forming station can be located at the end of a heating treatment apparatus or line and it is a common practice to deliver the rolled wire rod to the coil-collecting station on a generally horizontal conveyor and in the form of overlapping turns or "rings" which, at the end of this conveyor, fall into an upwardly open coiling chamber, which can be cylindrical, so that turns collect on a surface at the bottom of this chamber, e.g. around a mandrel. The pattern with which the rolled wire rod is delivered via the conveyor, i.e. the overlapping of the turns, is referred to occasionally as a spencerian pattern.

Various configurations of such systems have been provided heretofore with the end of collecting the overlapping turns from the conveyor, usually after cooling, into coils. The manner in which the turns are cast off the conveyor and can be collected in the upright chamber will vary depending upon the conveyor speed, the wire rod diameter and their metallic structure. As a practical matter, the movements of the turns are nonuniform if they are not controlled so that some type of improved lateral movement of the turns is required if the turns are to properly line up and deposit in a uniform compact coil.

In one arrangement, guide elements are provided at the upper end of the coil-forming chamber and have arms or guide surfaces which are eccentric to the inner wail of the chamber (EP 583 099 B1). In another arrangement, a ring is provided which is rotatable eccentrically with respect to the axis of the chamber and is located as the central section of the chamber (EP 686 439 A1). DE 1 970 04 421 describes an arrangement wherein above the mouth of the coil-forming chamber, a funnel-shaped ring element is provided.

In EP 686 438 A1, transverse shifters are described which have convex bodies which are driven about vertical axes or axes inclined to the vertical and define an asymmetrical cross section. These bodies are located around a laterally-open section of the coil-forming chamber, have a common drive means and engage the descending turns or rings of the rolled wire rod.

All of these systems have drawbacks with respect to the positioning of the descending wire rod turns or rings.

One of these drawbacks is that the paths defined by the guide elements cannot be varied in accordance with needs of the system, i.e. the prior art arrangements defining absolute paths for the descending coils or turns.

However a variation in the path may be desirable or necessary for different characteristics of the rolled wire rod, such as changes in the composition of the steel and changes in the diameter of the rolled wire rod.

Furthermore, problems can arise in operation of the apparatus, for example, the predetermined maximum height of a coil may be exceeded, there may be a jamming of the tip of the wire rod against a surface in the coiling chamber, or the turns or rings of the wire rod may themselves become dislocated or jammed against one or more of the transverse shifting elements or at an opening in the chamber wall and it may be necessary to free up the jammed workpiece or otherwise have access to the interior of the coiling chamber. Prior systems have proved to be incapable of accommodating such maintenance or repair operations or make such maintaining operations difficult. Experience has shown that with conventional apparatus it is not easy to free-up the cross section through which the turns fall to form the coil, especially when the coil is to be formed of relatively thick wire which frequently requires less lateral control of the positions of the descending windings or rings.

OBJECTS OF THE INVENTION

It is, therefore, the principal object of the present invention to provide an improved apparatus for the formation of rolled wire rod coils whereby these drawbacks can be avoided.

Another object of this invention is to provide an apparatus for the improved guidance of descending turns of rolled wire rod, arriving on a conveyor in a spencerian pattern, which reduces the tendency to jamming and dislocation and which, in particular, allows freeing-up of free space within the coiling chamber, thereby minimizing down time.

It is also an object of the invention to provide an improved apparatus for coiling rolled wire rod which affords better access to the coiling chamber than has hitherto been the case and which is more reliable and more readily maintained than earlier apparatus for this purpose.

SUMMARY OF THE INVENTION

These objects and others which will become apparent hereinafter are attained, in accordance with the invention in an apparatus for forming a coil of rolled wire rod which comprises:

a conveyor for advancing a succession of turns of rolled wire rod substantially horizontally to a coil-forming station;

wall means forming an upwardly open upright coil-forming chamber at the station receiving the turns from the conveyor, the chamber being formed with a surface upon which a coil of the rolled wire rod, formed by the turns, is collected; and turn-shifting means at the station engageable with turns descending in the chamber for transversely shifting same for alignment into the coil, the turn-shifting means including a plurality of angularly spaced swingable arms pivotally mounted outside the chamber and reaching into the chamber through openings in the wall means to engage the turns.

The apparatus can additionally have at least one drive located outside the chamber and coupled to these arms for displacing same. The drive can include a common actuator for all of the arms, can be an hydraulic, pneumatic or electromagnetic drive and can have one or more cam rings acting upon the arm at sides thereof opposite that at which the arms act upon the turns. The cam ring can have an eccentric surface surrounding the chamber and readily spaced therefrom or bulge successively engaging the arms as the ring is rotated. The drive can include individual control of the arms or sequential or group control thereof and the arms can have planar surfaces engaging the turns or slightly arched surfaces which engage the turns and these surfaces can be hardened or provided with antifriction coatings.

According to the invention, therefore, the transverse shifters are arms which are suspended from pivots located outside the coil-forming chamber and can reach through slits in the cylindrical wall of the coil-forming chamber into the interior thereof and can, of course, be withdrawn outside of the chamber. The arms, therefore, can swing in and out of the chamber through such slits.

Externally of the coil-forming chamber, shifting units can be provided for the common or independent actuation, hydraulically, pneumatically and electromagnetically of the arms and an eccentric ring can be rotatable and driven around the coil-forming chamber at a radial spacing therefrom. Alternatively, cam rings with individual cam drives can be provided to operate the arms.

The swingable arms are fitted with slight play in the slit in the wall of the coil-forming chamber.

The invention allows, apart from elimination of the aforementioned drawbacks, transverse displacement of the turns to be controlled by the positions of the swingable arms and their sequence of operation to suit any operating conditions and variation of these operating conditions to completely control the fall of the wire rod turns in the coil-forming chamber and hence the formation of a precise coil. Any control equipment or devices which may be required can be of fully conventional construction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
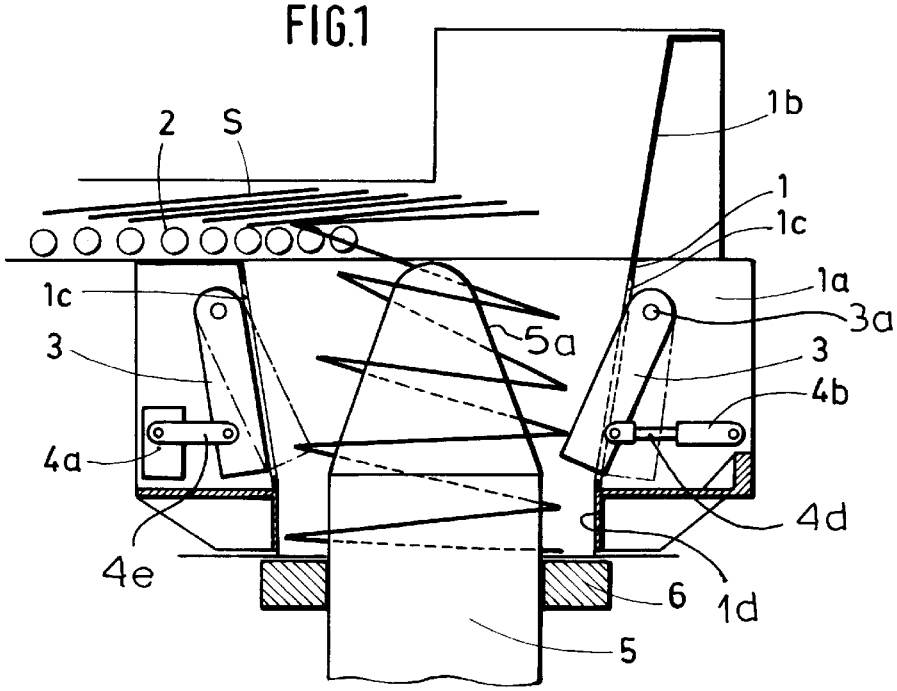
FIG. 1 is a vertical section in highly diagrammatic form illustrating an embodiment of the invention.
Figure 2:
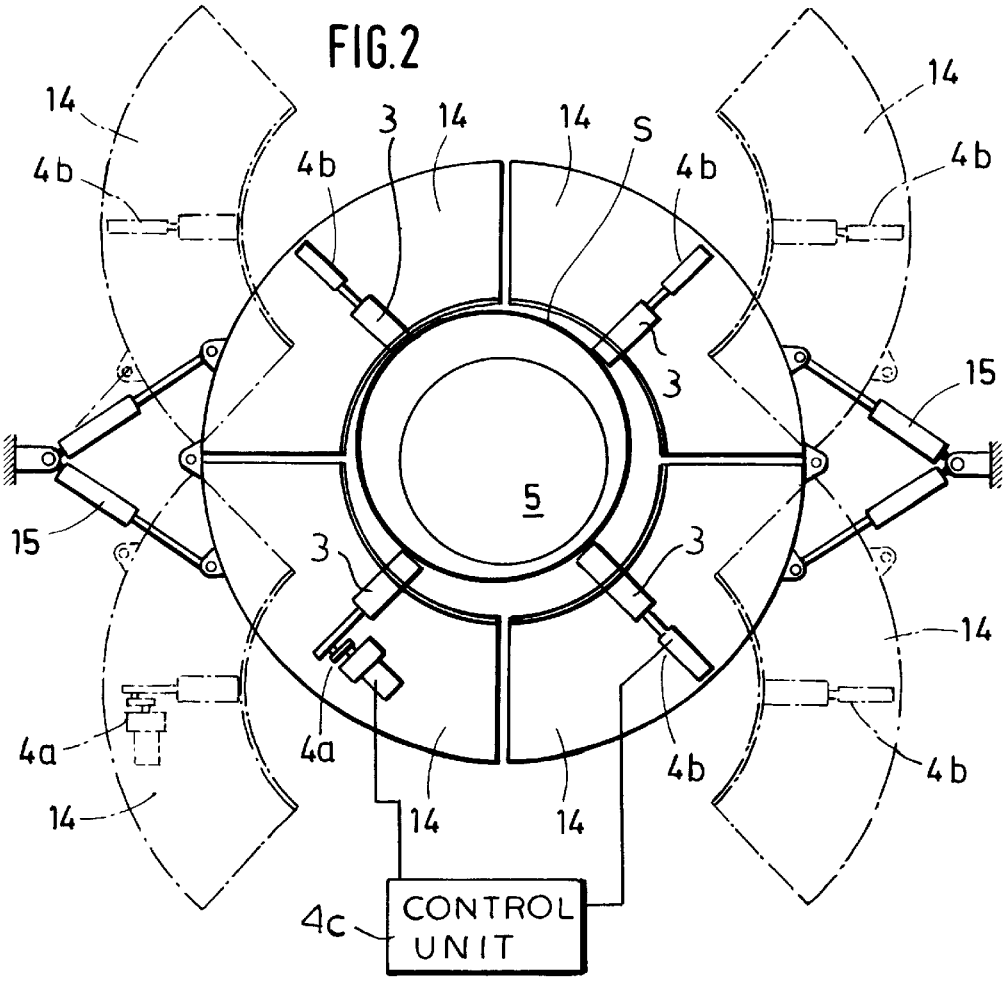
FIG. 2 is a plan view of an apparatus according to the invention.

As can be seen from FIGS. 1 and 2, a coil-forming chamber 1, which can be basically of cylindrical configuration, at least at its bottom part 1*d* and/or can have a generally conical wall, can be provided in a housing 1*a* and can have an inlet portion 1*b* into which a conveyor 2 can extend. The conveyor 2, here a roller conveyor, can deliver the overlapping rolled wire rod turns or rings S which arrive in the spencerian pattern described and fall into succession onto the coil-supporting plate 6 around a mandrel 5 which can extend upwardly in the chamber 1. The coil-supporting plate 6 is a ring surrounding the mandrel 5 which can have a conical upper end 5*a* and which serves as a collecting mandrel for the falling turns S. When an appropriate number of turns have been collected on the plate 6 to form the coil, the latter can be transported laterally on the plate 6 to a station in which the coil is tied and, if desired, wrapped.

The pivotal arms 3 which are angularly equispaced around the chamber are swingable about pivots 3*a* on the support housing 1*a* and are driven by a turn-shifting prime mover which engages at the back side of the arm 3, i.e. the side of the arm turned away from the chamber. The prime mover is here represented by an eccentric motor 4*a* or by piston and cylinder arrangements (pneumatic or hydraulic) represented at 4*b*. The motor 4*b* can represent as well an electromagnetic solenoid. The drives 4*a*, 4*b* are connected to a control unit 4*c* serving for individual operation of these drives, sequential operation thereof or group operation thereof. The drives 4*a*, 4*b* can be connected by rods or links 4*d* or 4*e* which are articulated to the arms 3 at their back sides.

Figure 6:
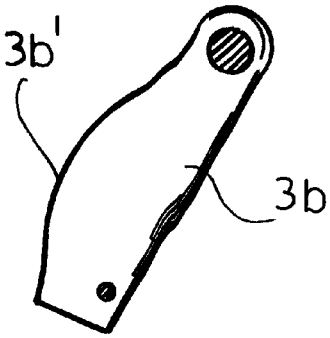
FIGS. 6–8 are views of swingable arms which can be used with the apparatus of FIGS. 1–5.
Figure 7:
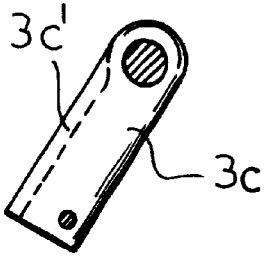
Figure 8:
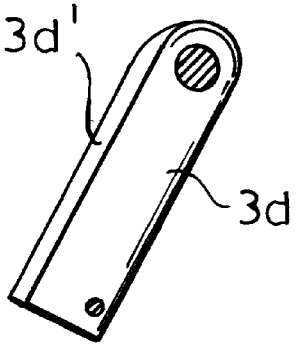

As can be seen for the arms 3*b*, 3*c* or 3*d* of FIGS. 6, 7, 8, the front side of the arm may have a bulge 3*b*' (or can be flat as shown in FIGS. 1 and 2), can be provided with a hard facing as at 3*c*' or can be formed with an antifriction coating 3*d*'.

The arms 3, etc., extend through longitudinal upright slits 1*c* in the wall forming the coiling chamber 1 so that they can be swung in and out by the drives (FIG. 2).

As the turns S cascade into the coiling chamber they are displaced eccentrically to the axis of the coil-forming chamber (FIG. 2) until they are deposited in the coil which collects coaxially to the mandrel 5 on the plate 6. The drives thus serve to accurately position the turns on the forming coil.

As can be seen from FIG. 2, moreover, the arms 3 and their drives 4, 4*b*, are carried by segment-shaped plates 14 of the support housing 1*a* so that they can be swung outwardly into the dot-dash line shown in FIG. 2 for mounting and repair and for lateral shifting of the plate 6 with the mandrel 5 or after the mandrel has been withdrawn, to displace the completed coil.

If desired safety switches or the like can be provided to prevent operation of the coiler until and unless the segments 14 have been fully swung back into the slide line positions shown. The means for swinging the segments can be piston and cylinder units 15 which can be hydraulically or pneumatically operated.

Figure 3:
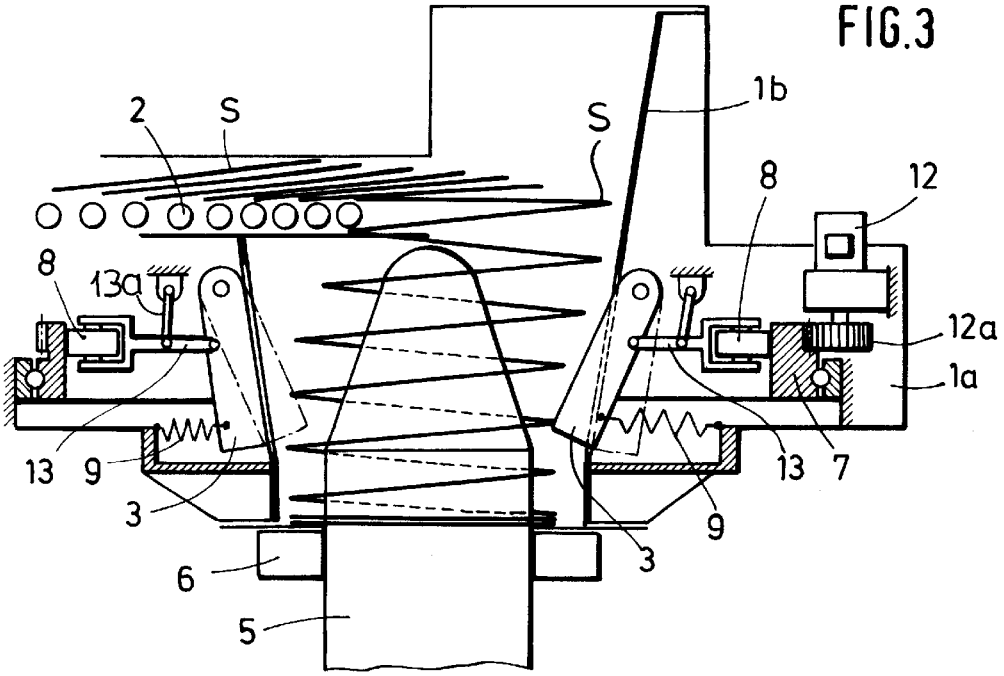
FIG. 3 is a view similar to FIG. 1 but showing another embodiment.
Figure 4:
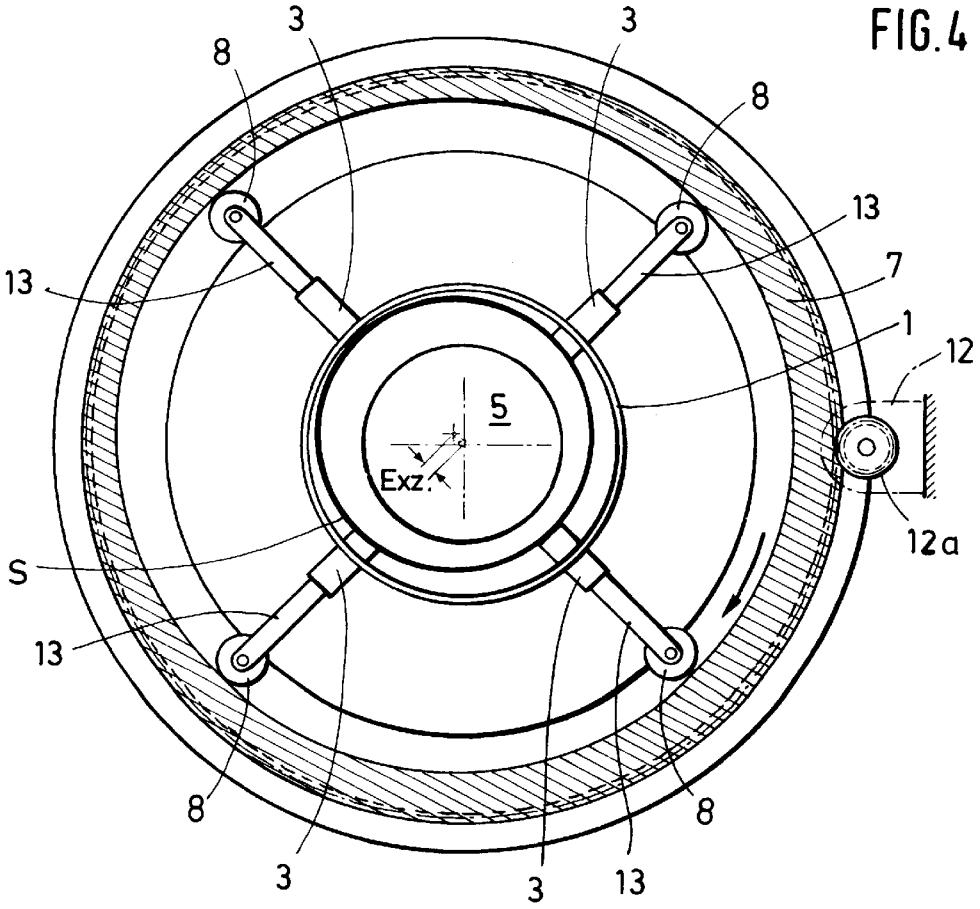
FIG. 4 is a cross sectional view through the apparatus of FIG. 3.

FIG. 3 shows a modification of the system of FIG. 1 wherein the arms 3 are swingable by an eccentric cam or ring 7 which has a crown gear engageable by a pinion 12*a* of a motor 12 (see also FIG. 4). Each of the arms 3 has a rod 13 which is supported by a link 13*a* pivotally connected at its ends to the housing 1*a* and to the rod 13 and carrying a cam follower roller 8 which rides on the ring 7. Tension springs 9 draw the lower ends of the arms 3 outwardly and thus maintain the cam follower roller pressed against the cam 7. The eccentric configuration of the ring 7 ensures that the arms 3 will follow the descending turns S and press these turns into alignment with the coil.

Figure 5:
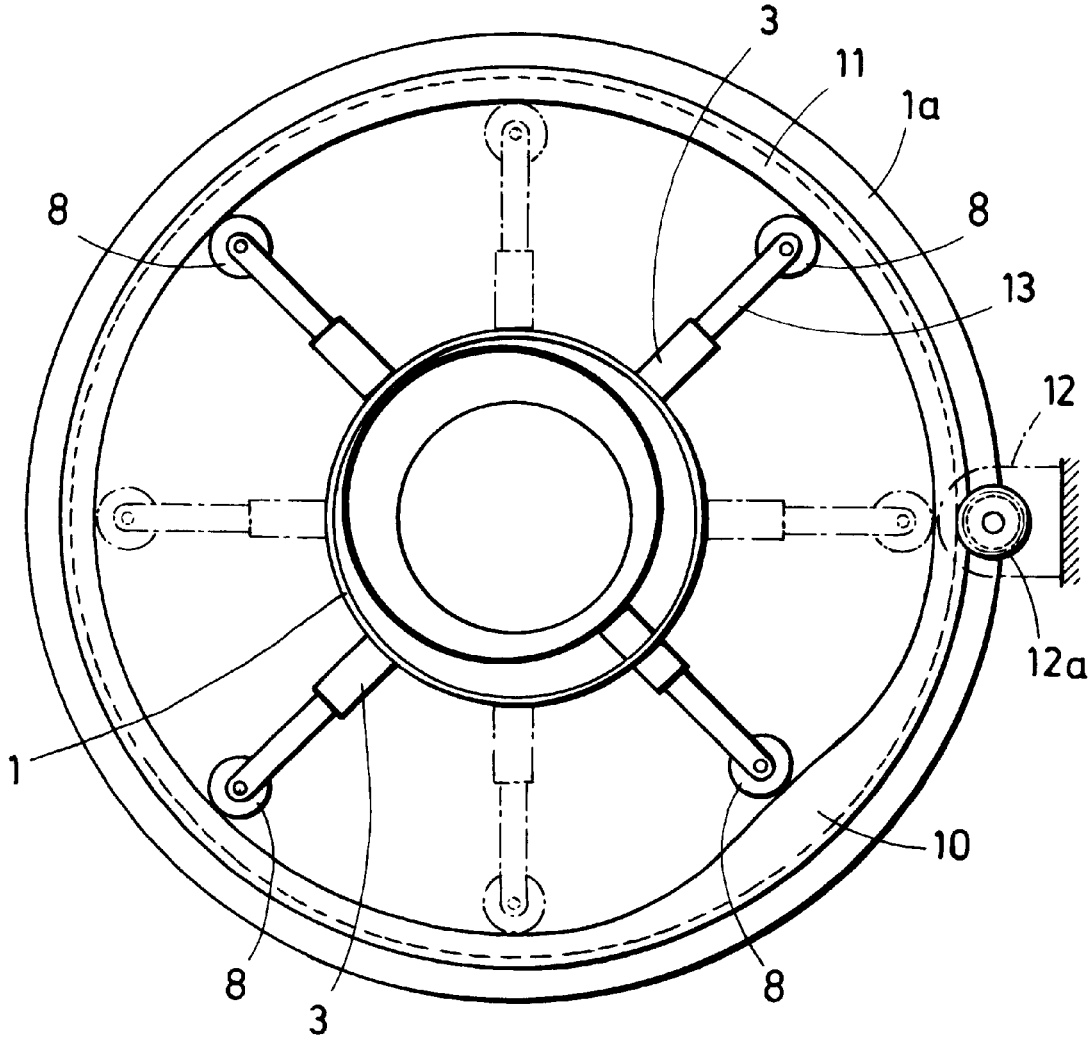
FIG. 5 is a diagrammatic plan view illustrating another system according to the invention.

FIG. 5 shows an embodiment of the invention in which in place of an eccentric ring, the cam 11 is cylindrical except for a cam surface 10 which projects inwardly and successively engages the cam follower rollers 8 to displace the respective pivotal arms 3 inwardly. With this construction, there is a position where, if four arms 3 are provided (see dot-dash lines in FIG. 5), all of the arms can lie outside the chamber 1 for removal of the coil without interference by an inwardly swung arm.

We claim:

1. An apparatus for forming a coil of rolled wire rod, comprising:

a conveyor for advancing a succession of turns of rolled wire rod substantially horizontally to a coil-forming station;

wall means forming an upwardly open upright coil-forming chamber at said station receiving said turns from said conveyor, said chamber being formed with a surface upon which a coil of said rolled wire rod, formed by said turns, is collected; and turn-shifting means at said station engageable with turns descending in said chamber for transversely shifting same for alignment into said coil, said turn-shifting means including a plurality of angularly spaced swingable arms pivotally mounted outside said chamber and reaching into said chamber through openings in said wall means to engage said turns.

2. The apparatus defined in claim 1, further comprising at least one drive located outside said chamber and coupled to said arms for displacing same.

3. The apparatus defined in claim 2 wherein said drive includes a common actuator for all of said arms.

4. The apparatus defined in claim 2 wherein said drive includes actuators individual to said arms.

5. The apparatus defined in claim 2 wherein said drive is a hydraulic drive.

6. The apparatus defined in claim 2 wherein said drive is a pneumatic drive.

7. The apparatus defined in claim 2 wherein said drive is an electromagnetic drive.

8. The apparatus defined in claim 2 wherein said drive includes a cam ring acting upon said arms at sides thereof opposite that at which said arms engage said turns.

9. The apparatus defined in claim 8 wherein said cam ring is formed with an eccentric surface surrounding said chamber and radially spaced therefrom.

10. The apparatus defined in claim 8 wherein said cam ring is formed with a bulge successively engaged with said arms.

11. The apparatus defined in claim 2 wherein said drive includes individual control of said arms.

12. The apparatus defined in claim 2 wherein said drive includes sequential control of said arms.

13. The apparatus defined in claim 2 wherein said drive includes group control of said arms.

14. The apparatus defined in claim 2 wherein said arms have planar surfaces engaging said turns.

15. The apparatus defined in claim 2 wherein said arms have slightly arched surfaces engaging said turns.

16. The apparatus defined in claim 2 wherein said arms have hardened surfaces engaging said turns.

17. The apparatus defined in claim 2 wherein said arms have surfaces engaging said turns provided with an antifriction coating.

* * * * *